US009765485B2

(12) United States Patent
Keen

(10) Patent No.: US 9,765,485 B2
(45) Date of Patent: Sep. 19, 2017

(54) MOVEMENT JOINT

(75) Inventor: Andrew Keen, Ivybridge (GB)

(73) Assignee: Permaban Limited, Ivybridge, Devon (GB)

( * ) Notice: Subject to any disclaimer, the term of this patent is extended or adjusted under 35 U.S.C. 154(b) by 0 days.

(21) Appl. No.: 14/344,083

(22) PCT Filed: Aug. 31, 2012

(86) PCT No.: PCT/GB2012/000694

§ 371 (c)(1),
(2), (4) Date: Mar. 11, 2014

(87) PCT Pub. No.: WO2013/038123

PCT Pub. Date: Mar. 21, 2013

(65) Prior Publication Data

US 2014/0366472 A1 Dec. 18, 2014

(30) Foreign Application Priority Data

Sep. 14, 2011 (GB) ..... 1115940.7

(51) Int. Cl.

| | |
|---|---|
| ***E01C 11/02*** | (2006.01) |
| ***E01C 11/14*** | (2006.01) |
| ***E01D 19/06*** | (2006.01) |
| ***E01C 11/08*** | (2006.01) |

(Continued)

(52) U.S. Cl.

CPC ..... *E01C 11/08* (2013.01); *E01C 11/04* (2013.01); *E01C 11/06* (2013.01); *E01C 11/14* (2013.01); *E01D 19/06* (2013.01); *E01D 19/062* (2013.01)

(58) Field of Classification Search

CPC ..... E04C 11/02; E04C 11/04; E04C 11/06; E04C 11/14; E01D 19/06; E04B 1/68; E04B 1/6807; E02D 29/16

USPC .. 52/393, 394, 395, 396.01, 396.02, 396.03, 52/396.04, 396.05, 396.06, 396.07, (Continued)

(56) References Cited

U.S. PATENT DOCUMENTS 1,495,305 A * 5/1924 Heltzel ..... 249/6
2,031,371 A * 2/1936 Kerr ..... 404/56

(Continued)

FOREIGN PATENT DOCUMENTS

BE 1 015 453 A3 4/2005
DE 35 33 077 A1 3/1987

(Continued)

*Primary Examiner* — Joshua J Michener
*Assistant Examiner* — Kyle Walraed-Sullivan
(74) *Attorney, Agent, or Firm* — Bay State IP, LLC

(57) ABSTRACT

A free movement, arris protection, construction joint has a pair of arris protection members formed complementarily from strips of sheet with a continuous trapezium wave form. A divider one of the members is typically 100 mm deep for a nominal 0.1 m deep slab. The other one is typically 50 mm deep. The members are of steel plate.

The wave form is comprised of flanges extending in the length of the joint and of webs angled to the flanges and the length of the joint. The flanges are spaced on opposite sides of a mid-plane of the joint. The members are bolted together with flangible nylon bolts, with their top (in use) edges flush. Welded to the outer ones of the flanges are L strips having apertures in their flats extending from the flanges for anchoring the joint to its slabs.

12 Claims, 9 Drawing Sheets

(51) Int. Cl.
*E01C 11/04* (2006.01)
*E01C 11/06* (2006.01)

(58) Field of Classification Search
USPC ..... 52/396.08, 396.09, 396, 1, 402; 404/47, 404/50, 51, 56, 61, 68
See application file for complete search history.

(56) References Cited

U.S. PATENT DOCUMENTS

| | | | | | |
|---|---|---|---|---|---|
| 2,419,022 | A * | 4/1947 | Heltzel | E01C 11/14 | 404/59 |
| 2,521,643 | A * | 9/1950 | Mathers | 404/61 |
| 3,059,553 | A * | 10/1962 | Woolley | 404/62 |
| 4,050,207 | A * | 9/1977 | Bertschmann et al. | 52/396.05 |
| 4,332,504 | A * | 6/1982 | Arai | 404/68 |
| 4,936,704 | A * | 6/1990 | Killmeyer | 404/74 |
| 5,088,256 | A * | 2/1992 | Face, Jr. | 52/396.04 |
| 5,366,319 | A * | 11/1994 | Hu et al. | 404/52 |
| 5,826,391 | A * | 10/1998 | Underwood | 52/414 |
| 8,376,652 | B2 * | 2/2013 | Bradford | 404/70 |
| 2004/0016065 | A1 * | 1/2004 | Steiger et al. | 14/73.1 |
| 2005/0066600 | A1 * | 3/2005 | Moulton et al. | 52/393 |
| 2006/0059804 | A1 * | 3/2006 | Brown | 52/223.13 |
| 2007/0199267 | A1 * | 8/2007 | Moor | 52/393 |

FOREIGN PATENT DOCUMENTS

| | | |
|---|---|---|
| EP | 1 389 648 A1 | 2/2004 |
| EP | 1 867 783 | 12/2007 |
| FR | 2 848 581 | 6/2004 |
| GB | 2 421 049 | 6/2006 |
| WO | 2007/144008 | 12/2007 |

* cited by examiner

MOVEMENT JOINT

CROSS REFERENCE TO RELATED APPLICATION

This application is for entry into the U.S. National Phase under §371 for International Application No. PCT/GB2012/000694 having an international filing date of Aug. 31, 2012, and from which priority is claimed under all applicable sections of Title of the United States Code including, but not limited to, Sections 120, 363, and 365(c), and which in turn claims priority under 35 USC 119 to United Kingdom Patent Application No. 1115940.7 filed on Sep. 14, 2011.

BACKGROUND OF THE INVENTION

Field of the Invention

The present invention relates to a movement joint, in particular of the type used in the laying of concrete, remaining in place thereafter and allowing free movement of concrete slabs on opposite sides of the joint.

Description of the Related Art

Movement joints are provided between concrete slabs to allow them to separate at intended joint lines as the concrete shrinks on curing after laying.

Many joints include a divider between adjacent slabs and against which concrete is poured. In this respect, the joints perform the function of concrete shuttering. In this specification, we refer to such a joint as a "construction joint". In a construction joint the divider will be suited to the nominal depth of the concrete. It may not be the full depth of the slabs in that the sub-base on which the concrete is laid may not be sufficiently level for the divider to abut the sub-base along the entire length of the joint. In such situation, some concrete can be expected to pass under the divider, but the depth will be sufficient for the concrete to be tamped level with the top of the joint.

The edges or arrises of the concrete at a joint require support against spalling, that is breaking off in shear and/or impact as from forklift truck tyres.

Many forms of arris protection have been used. One early example, left in situ from casting, was the use of angle irons set up on wooden shuttering.

More recently strip steel on edge has been used, anchored into the concrete, normally by means of a number of studs angled down and extending towards the body of the slab. A typical construction joint of this type is shown in our patent application No EP 1,867,783. It's abstract is:

> "Apparatus for forming the edge of a concrete floor slab, the apparatus comprises a divider plate formed with a plurality of apertures, dowels for engaging through the apertures and sleeves for applying to the dowels, in which the divider plate is provided with means, in use, to adjust the height thereof above the ground. The height-adjustment means comprises a removable jack."

In this joint, known as our Alpha Joint, we provided a pair of arris protection rails, one welded to the top of the divider plate and the other frangibly connected to the one. Each was provided with spaced anchor bolts for anchoring the rails to their concrete slabs. The arris rails being of square section had good anti-spalling action.

Despite providing a good measure of protection against spalling, this joint has an inherent problem in that, wherever a joint is straight and has opened to tens of millimeters, due to tyres, typically of a fork lift truck having solid tyres and little or no sprung suspension, dropping partially into the opening and striking against the opposite side of the joint. The resulting impacts are liable to cause eventual deterioration of the joint.

Various arrangements have been provided for further reinforcement of the arrises including plates set flush with the surface of the concrete, as developments of the use of angle irons. Amongst these developments are plates extending across the opening in the joint. Further, these plates can have interdigitated edges, whereby a tyre passing across the joint encounters a sinusoidal gap between the plates. This is advantageous in preventing the simultaneous impact across the width of a tyre passing over the gap.

Such sinuosity has been provided not only in horizontal plates but also in arris members extending down from the surface of the concrete having the joint. These sinusoidal arris members have been mounted on top of vertical members extending lower into the joint. This makes for cost and complexity in fabrication.

SUMMARY OF THE INVENTION

The object of the present invention is to provide an improved free movement, construction joint.

According to the invention there is provided a free movement, arris protection, construction joint for dividing the concrete during pouring of slabs on opposite sides of the joint, the joint having a top-to-bottom depth in its use orientation, giving this depth to the slabs, the joint comprising:

a pair of elongate fabrications one for each side of the joint and means for frangibly connecting the formations together, the fabrications including:

means for anchoring them in the respective concrete slabs on opposite sides of the joint, arris protection members for the respective concrete slabs at each side of the joint, the arris protection members being complementarily formed along the length of the joint with a regular wave shape, with each member extending regularly across a mid-plane of the joint from one side to the other and back again at successive positions along the joint at least whilst the fabrications remain frangibly connected, at least one of them having width transverse the length of the joint giving the joint its top-to-bottom depth and being configured to act as a divider for dividing the concrete slabs and the regular wave shape extending throughout the depth of the arris protection members, including the or each dividing one, whereby on pouring the slabs are formed with interdigitated concrete fingers edged at their arrises by the arris protection members and extending through the depth of the slabs.

Whether one only or both of the wave shaped arris protection members extends to the full depth of the joint, it imparts the wave shape to the concrete to the depth of the joint at least, as joint opens. Not only does this arrangement provide for progressive load transfer from one slab to the next as a vehicle crosses the joint, but the portions of the concrete extending furthest towards the other slab do not react the load applied to them as unsupported fingers in bending, but as columns in compression—in which stress state concrete is well known to be stronger.

The wave form can be curved such as sinusoidal, or angular as in saw tooth, triangular or square. The preferred wave form is trapezoidal, in maximising the range of the angles of approach of vehicles to the joint in which progressive load transfer is achieved.

As intimated above, both arris protection members can have the same depth in the joint. However, in some embodiments, one of the arris protection members, although being flush at the intended concrete level, is not so deep at as the other, divider one.

Preferably the anchor features are comprised of continuous welded on members, the welding conveniently being at the furthest extent of the arris-protection/divider members from the mid plane of the joint, that is at lateral wave peaks. In the preferred embodiment, the members are angle members with apertures punched for anchoring in the concrete. Alternatively the anchoring members can be lengths of reinforcing bar, again welded to the lateral wave peaks and anchoring at their extent through the concrete between the peaks.

Whilst it is envisaged that the or additional anchoring features could be provided close to the flush edges of the arris-protection/divider members, this is not expected to be necessary with these members being wave shaped and the anchoring features as preferably set down from the flush edges.

As normal for free movement, arris protection, construction joints, the divider member is preferably provided with welded-in-place dowels extending plainly outwards of the mid-plane on the divider side and having sleeves in their extent on the other side of the joint for transferring vertical load between the slabs on opposite sides of the joint. The dowels may be of the plate or bar type.

Preferably, the ends of the joint are complementarily formed for connection of another such joint to the end of the joint, the joint having:

a portion of one arris protection member extending beyond the other at one end, a complementary portion of other arris protection member extending beyond the one at the other end and means for frangibly connecting the said portions together for connecting the joint to another such joint.

Further it is preferred that part of the anchoring means at the side of the joint having the one portion extends onto and is fixed onto the one portion and is fixed onto the other end of the side of the joint short of the complementary portion of the other arris protection member.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENTS

Figure 1:
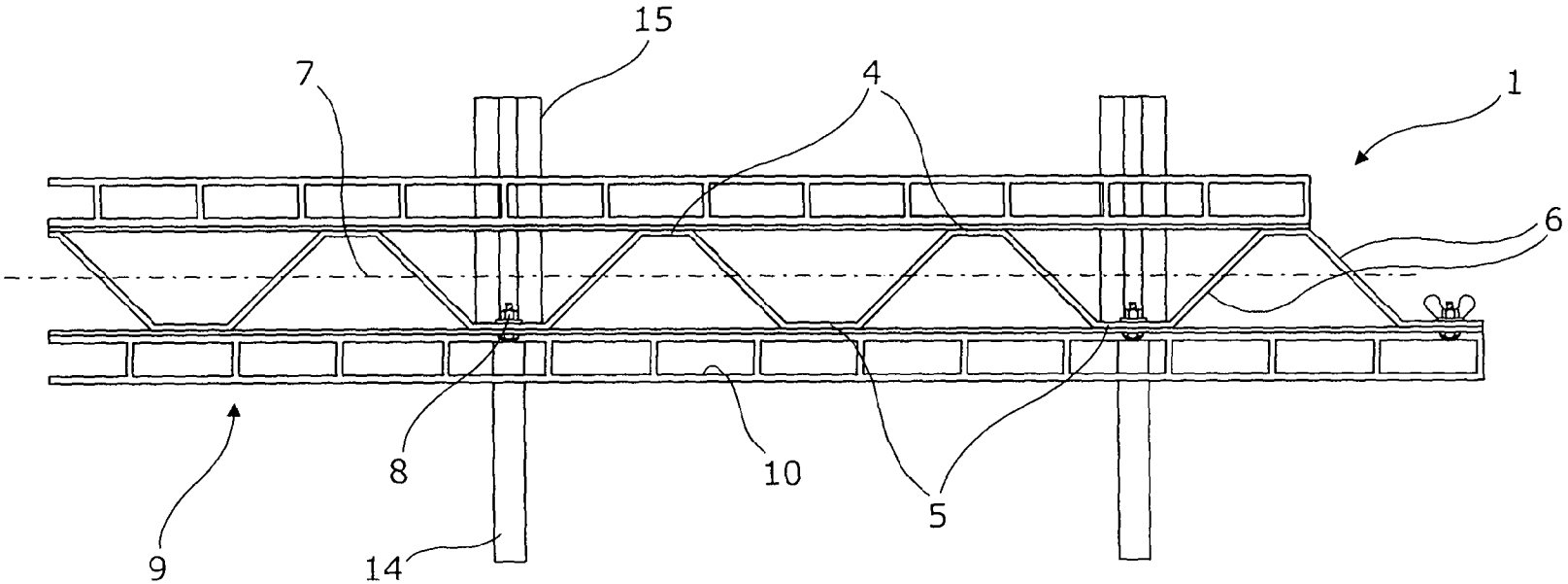
FIG. 1 is a plan view of a free movement, arris protection, construction joint according to the invention.

Referring to the drawings, a free movement, arris protection, construction joint 1 has a pair of arris protection members 2,3 formed complementarily from strips of sheet with a continuous trapezium wave form. A divider one 2 of the members is typically 100 mm deep for a nominal 0.1 m deep slab. The other one 3 is typically 50 mm deep. The members are of 2 mm steel plate, either mild (possibly galvanised) or stainless.

The wave form is comprised of flanges 4,5, typically extending 150 mm in the length of the joint and of webs 6, extending at 45° to the flanges and the length of the joint. The flanges 4,5 are spaced 150 mm on opposite sides of a mid-plane 7 of the joint. The members 2,3 are bolted together with flangible nylon bolts 8, with their top (in use) edges flush.

Welded to the outer ones of the flanges are L strips 9 having apertures 10 in their flats 11 extending from the flanges for anchoring the joint to its slabs. The bolts pass through welded on ones 12 of the flats of the divider plate anchor strip.

Beneath the anchor members, extending out from every other flat 5 of the deep divider one 2 of the protection members are load transfer dowels 14, with sleeves 15 on their extent across the mid-plane and beyond.

Figure 3:
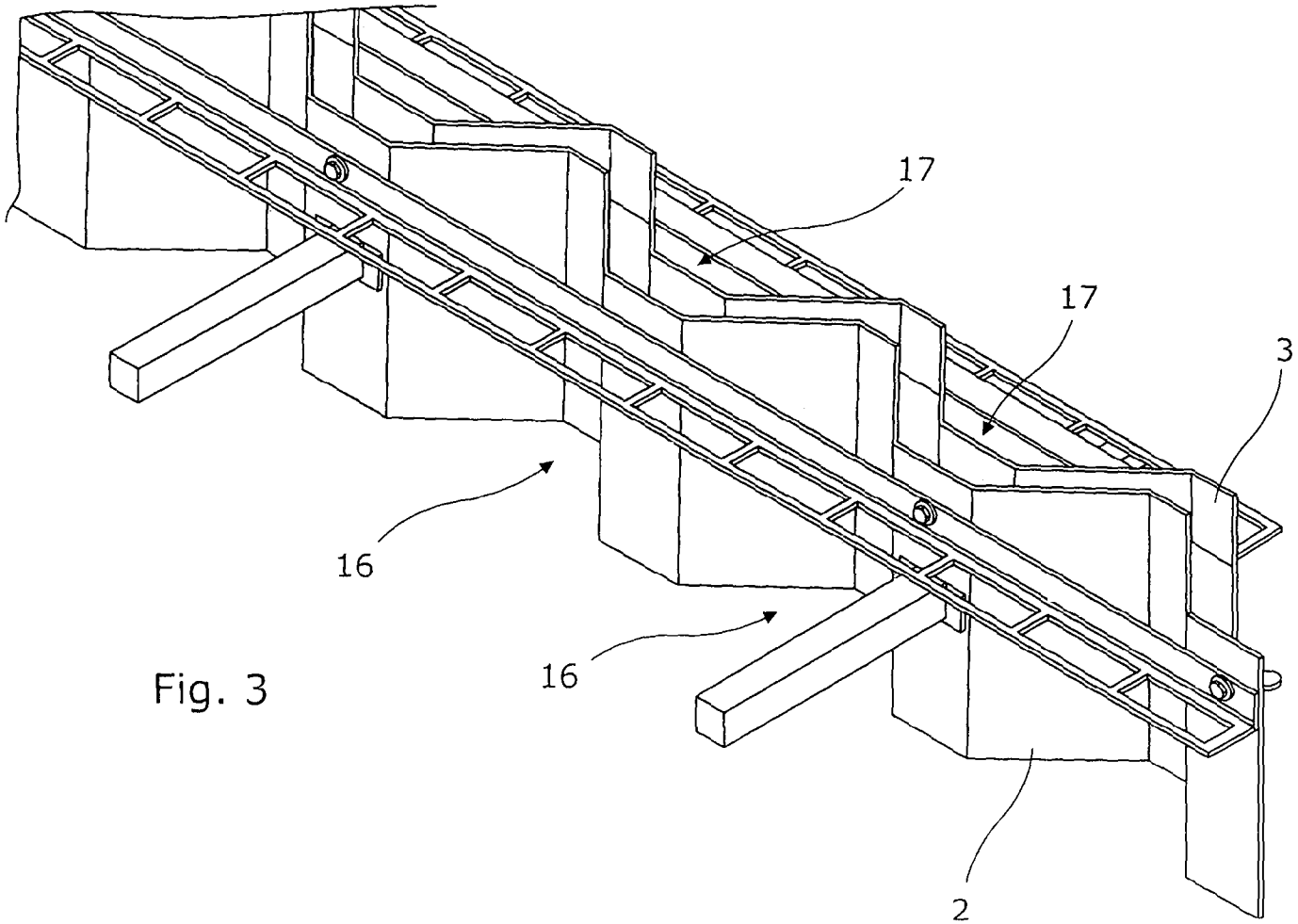
FIG. 3 is a view similar to FIG. 2 of the joint when open as induced by concrete shrinkage.
Figure 4:
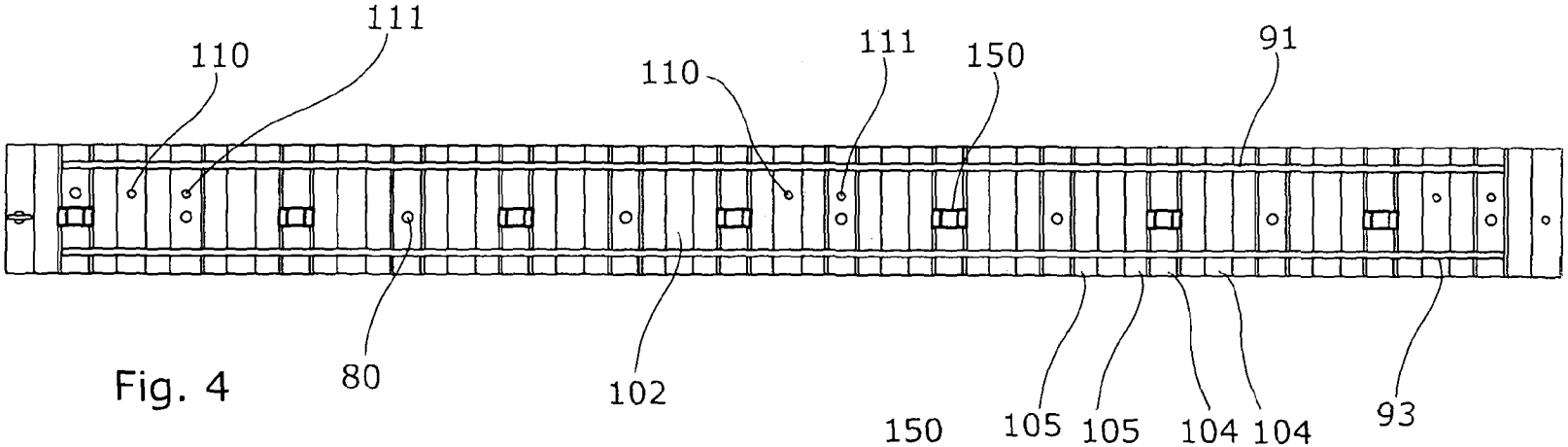
FIG. 4 is a side view of second joint of the invention.
Figure 5:
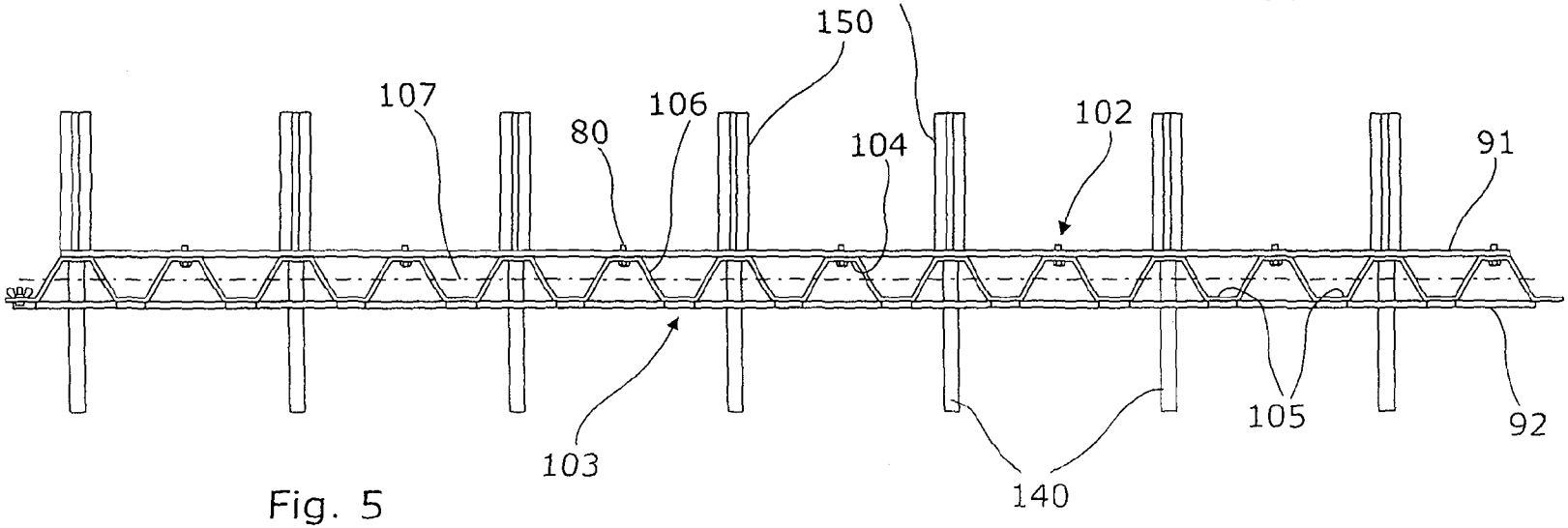
FIG. 5 is a plan view of the second joint of FIG. 5.
Figure 6:
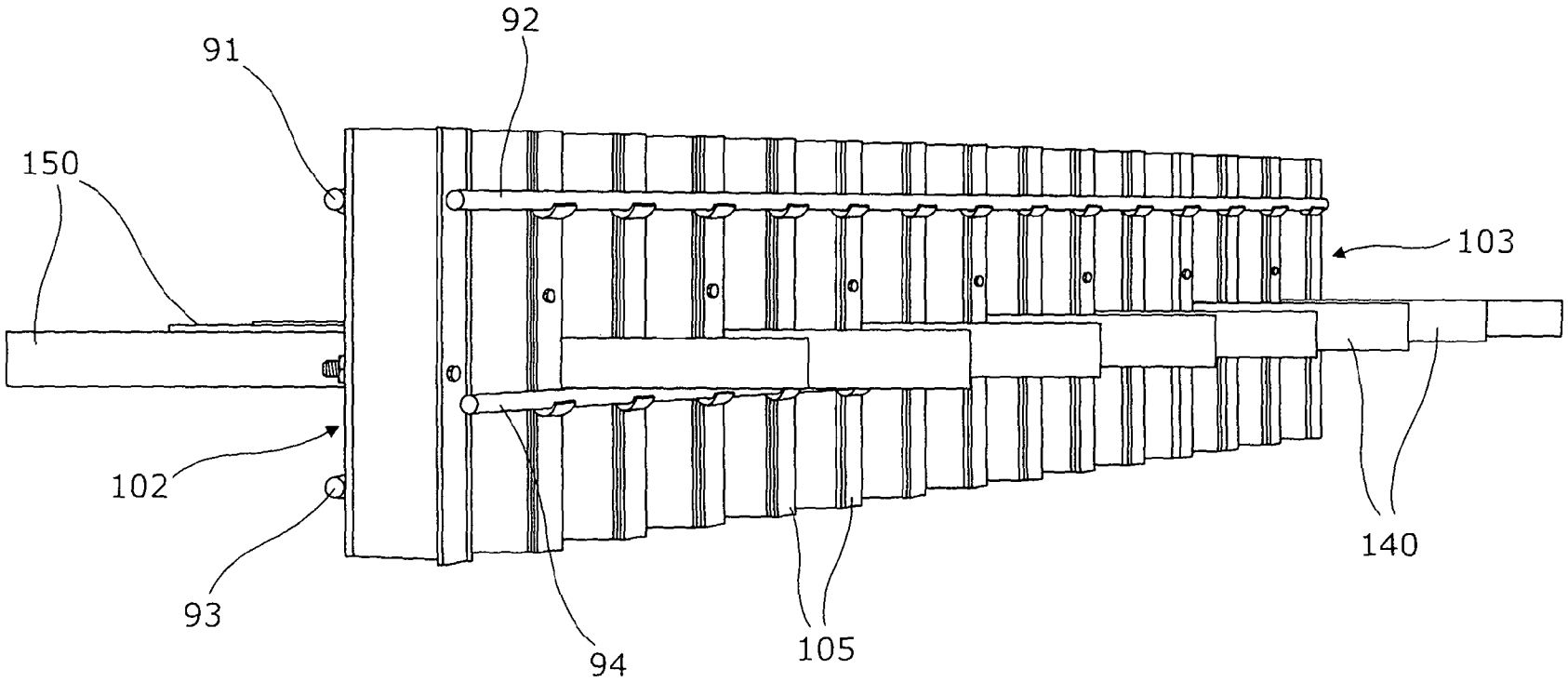
FIG. 6 is a perspective end view of the second joint of FIG. 5.
Figure 7:
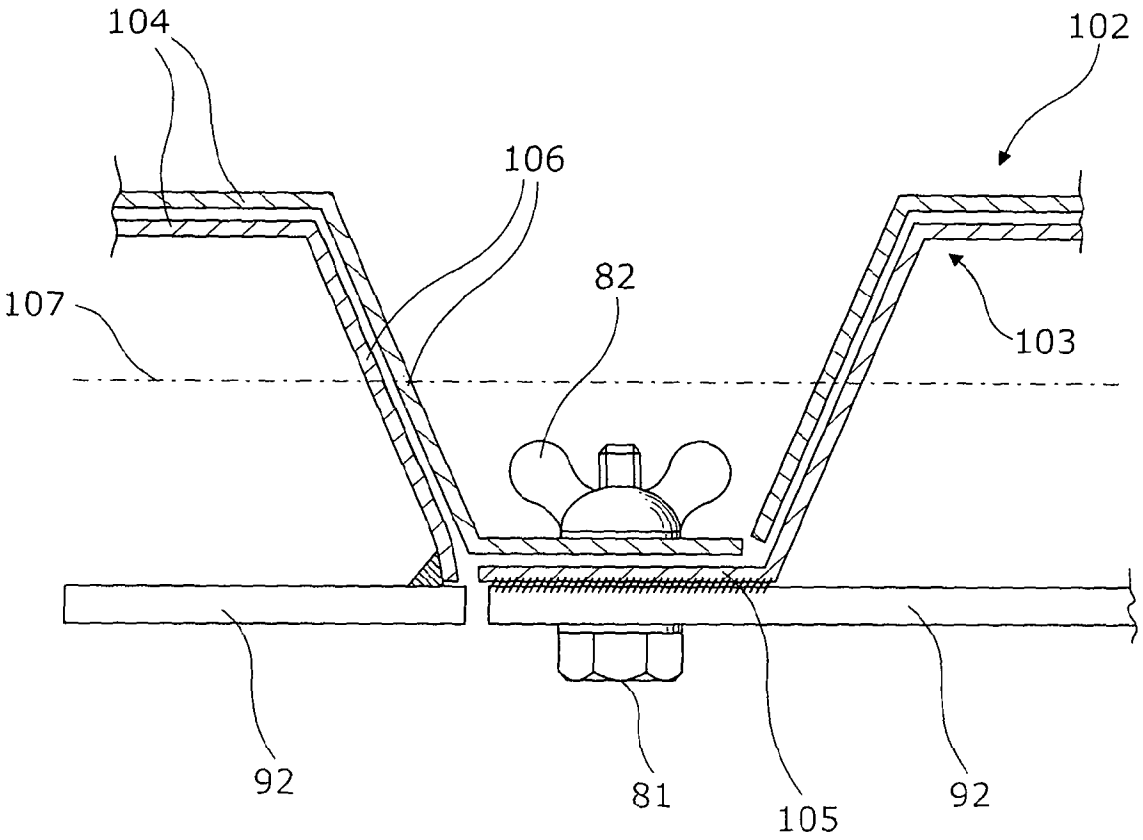
FIG. 7 is a scrap plan view of the joint of FIG. 5 connected to another such joint.
Figure 8:
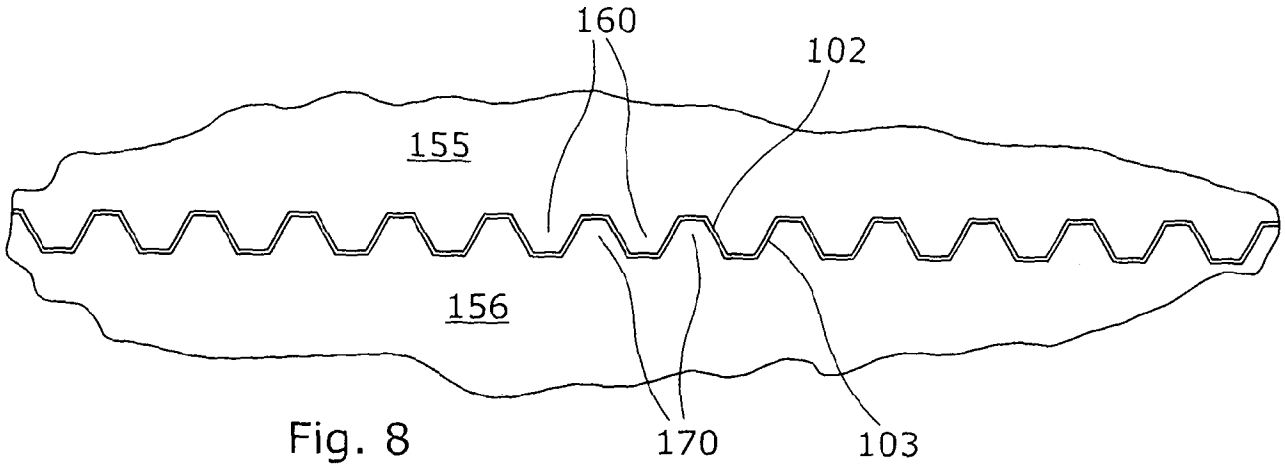
FIG. 8 is a plan view of the joint of FIG. 5 between two concrete slabs on initial curing of the concrete.
Figure 9:
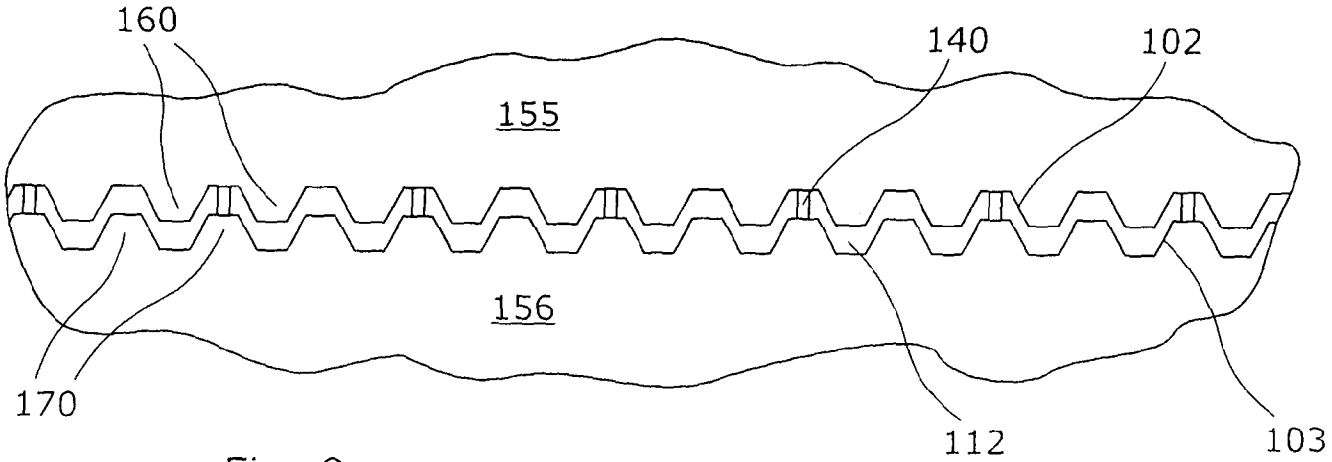
FIG. 9 is a plan view similar to FIG. 8 after concrete shrinkage and joint opening.
Figure 10:
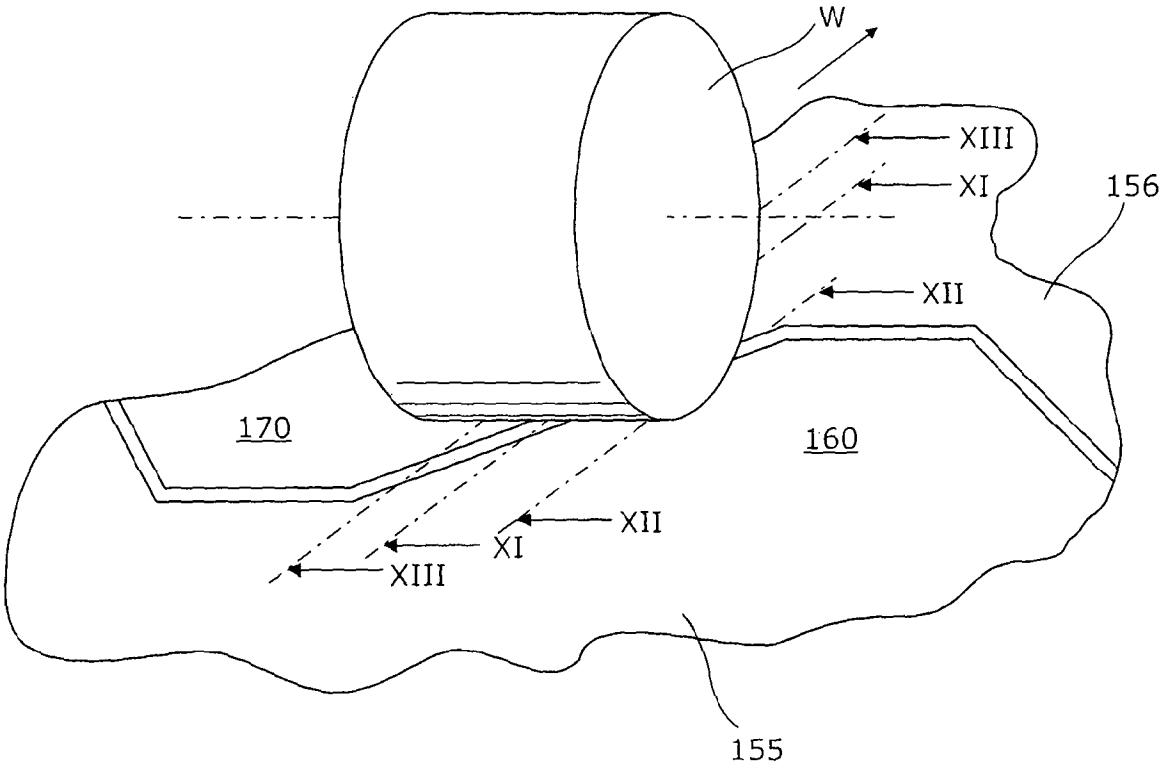
FIG. 10 is a perspective view of a wheel supported at the joint of FIG. 5.
Figure 11:
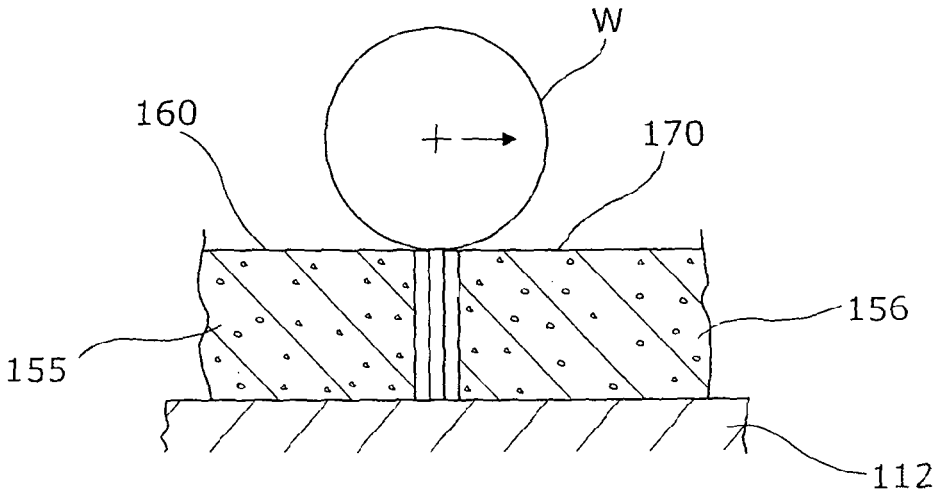
FIG. 11 is a cross-sectional end view of the joint and concrete on the line XI-XI in FIG. 10, i.e. through joint members on the mid-plane of the joint, with the wheel centred on the mid-plane.
Figure 12:
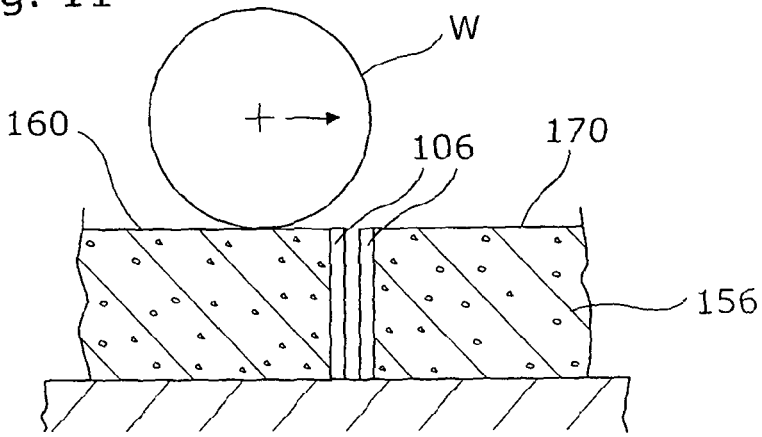
FIG. 12 is a similar cross-sectional view on the line XII-XII in FIG. 10, i.e. through a castellation extending from one slab with one side of the wheel supported on this slab and its castellation.
Figure 13:
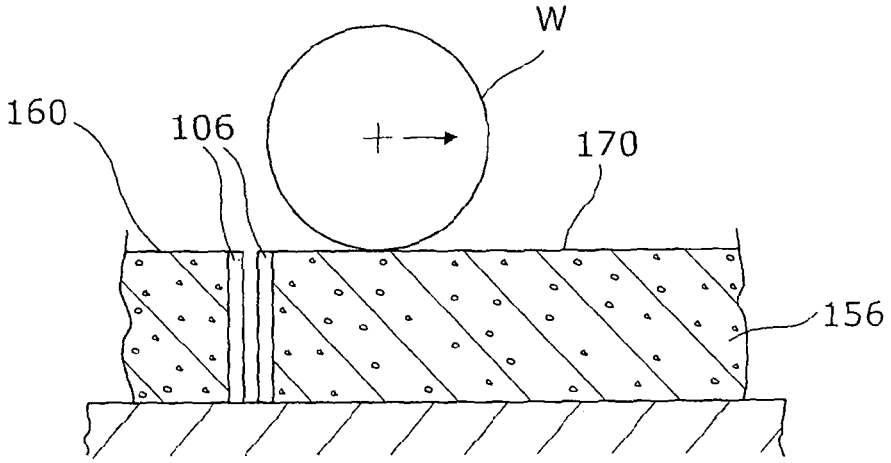
FIG. 13 is a similar cross-sectional view on the line in FIG. 10, i.e. through a castellation extending from the other slab with the other side of the wheel supported on this other slab and its castellation.

In FIG. 3 the joint is shown separated, albeit without concrete being shown. It will be appreciated that the concrete is cast with a horizontally castellated edge, castellations at positions 16 being bounded by the divider member 2. Complementary castellations on the other side of the joint at the positions 17 interdigitate with the first castellations 16. As the joint opens, with concrete slab shrinkage, the castellations and their arrises are edged and protected by the members 2,3. The castellations extend to the full depth of the slabs. Thus as a vehicle moves over the joint, the load applied down onto the castellations is compressively transferred to the sub-base, below the slabs. The castellations are full depth to the sub-base and in the absence of impact loads, with the wave-form gap developing between being too small for the vehicle's wheel to enter, the castellations can be expected to have a long life. With no or negligible impact loads the arrises of the castellations will not be subject to crack inducing stresses. The members 2,3 are kept in close contact with their castellations where these are bounded by at the gap by the relatively short flanges 4,5 which are tied back by the webs 6 to the other flanges 4,5. The latter are anchored to the concrete by the anchoring strips 9.

Figure 2:
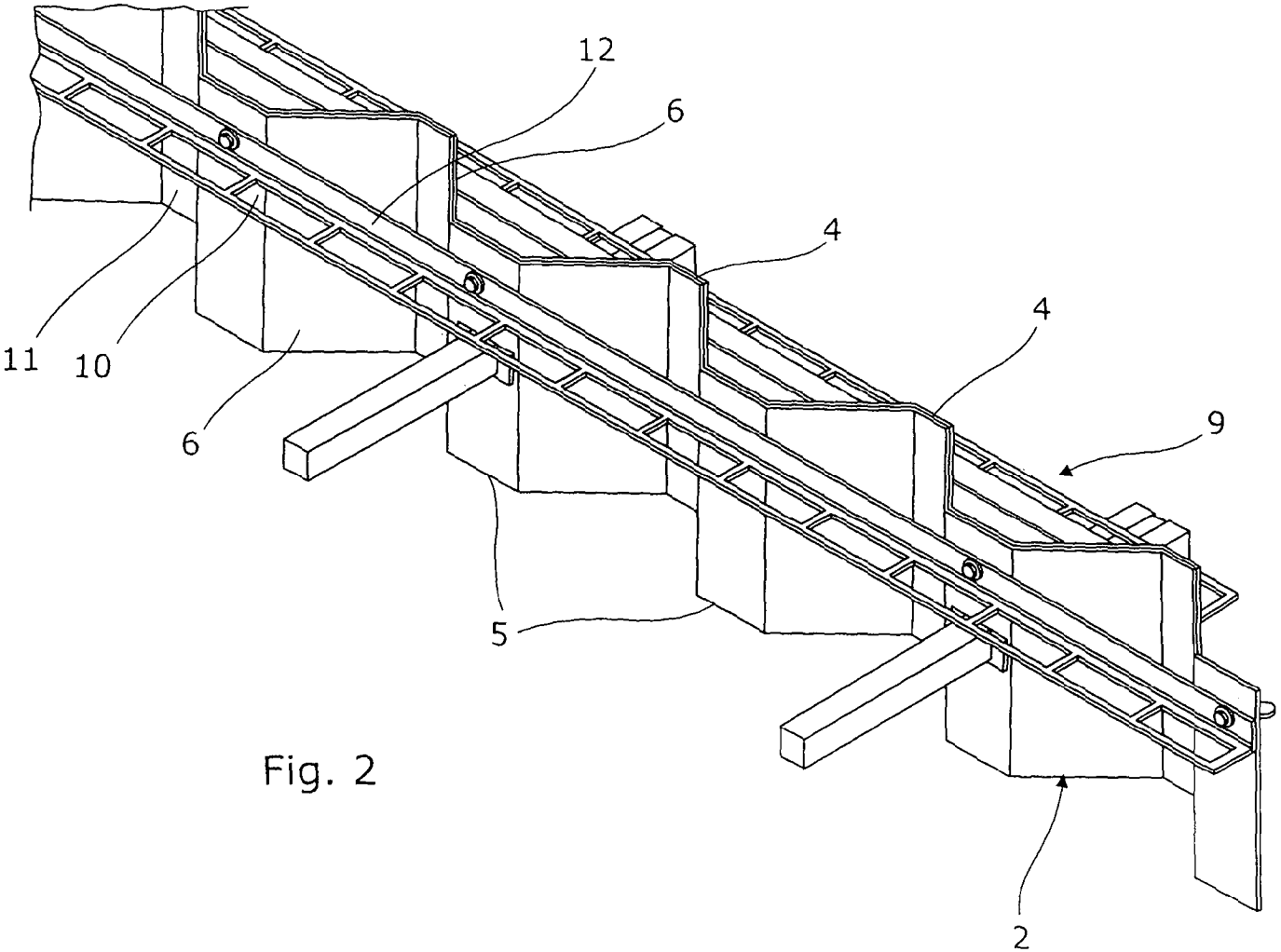
FIG. 2 is a perspective view of the joint of FIG. 1, when closed as in FIG. 1.

Turning now to FIGS. 4 to 11, the second joint is essentially similar to that of FIGS. 1 to 3, except that the webs 106 are set at 60° to the flanges 104,105. The pitch of the wave form is 150 mm, the flanges are spaced nominally by 50 mm on opposite sides of the mid-plane 107 and the flanges are nominally 42 mm long. The skilled reader will (i.) appreciate that with each of the arris protection joint members 102,103 being comprised of flanges 104 and flanges 105 interconnected by webs 106, for the members to fit closely together, each of the flanges 104,105 are of slightly shorter and slightly longer ones, lying against each other and connected to webs lying against each other, and (ii.) be able to calculate the exact dimensions of the shorter and longer flanges to enable the members 102,103 to fit together. As shown, both members 102,103 are nominally 175 mm wide for this depth slab.

The outside/longer ones of the flanges 104,105 have two lengths of 8 mm rebar welded to them. Three of four of these lengths 91,92,93 are set 30 mm from the edges of the members. The fourth 94 is set 60 mm from its respective edge. At this level it has 20×20 mm square dowels 140 extending above it, the dowels being welded to this bar and to the joint member having this rebar welded to it. The dowels are provided at every other peak of the sinuosity of the joint on one side thereof. They extend 160 mm from the rebar. On the other side of the joint, the dowels extend by 200 mm and each has a plastic sleeve 150. This further extension allows for 40 mm of joint opening and still the same 160 mm within the sleeve, for load transfer. This arrangement places the dowels below one third of the depth of the joint, whereby they are not liable to be cut into if and when the slabs are saw cut for stress relief—normally to one third the depth of the slab. On the other hand, the upper anchoring rebar lengths 91,92 are within the top third of the depth of the joint and are liable to be cut into in saw cutting. Nevertheless, they retain their efficacy in anchoring the joint members at the saw cut due to their regular welding to the flanges of the members.

It will be noted that the joint members 102,103 have a series of apertures 110,111 for known supports to hold the joint at installation height above the sub-base 112. The apertures are provided in pairs on adjacent flanges 104,105 on opposite sides of the joint, whereby the joint can be supported from either side. Further, the joint members are frangibly connected together by nylon bolts 80 spaced along the joint between the dowels and at the same height as them. Further frangible bolts 81 and wing nuts 82 are provided for interconnecting joints end to end for an extended joint. At one end of the individual joints, the rebar lengths 92,94 are welded onto an outer flange 105, with the inner flange being omitted here. At the other end, the inner flange 105 is present, and the rebar lengths are welded to the ends of the web 106 of their joint member. The ends are complementary and are bolted together in use by a bolt 81 and wing nut 82. This arrangement provides continuity along the joint of divider capability for concrete pouring.

Once slabs 155, 156 are cast on opposite sides of the joint, the rebar lengths are embedded in the concrete for anchoring of the joint members. The slabs extend as inter-digitated castellations 160,170 separated by the sinuosity of the joint. The castellations extend to the sub-base 112. Progressive load transfer from one slab to the next can the appreciated from FIGS. 8 to 11. Initially the wheel is supported on one slab 155. As it approaches the joint, load is transferred to the other via the dowels. At the joint, it is supported first primarily on a castellation 160 of the first slab 155 and progressively on a castellation 170 of the other slab 156 as it rolls over the joint obliquely along the webs 106 beneath it. Thus there is a progressive transfer of load from one slab to the other.

The invention is not intended to be restricted to the details of the above described embodiments. For instance, other sinuous wave forms could be used in particular sinusoidal. Further it is not essential for both of the arris protection members of the joint to be of full slab depth. For deep slabs, material can be economise on by the bottom of one stopping short of full depth. With such an arrangement, one rebar anchor can be envisaged for this member but two will normally be provided.

The invention claimed is:

1. A free movement, arris protection, construction joint for dividing a concrete during pouring of slabs on opposite sides of the joint, the joint having a top-to-bottom depth in the joint's use orientation, giving depth to the slabs, the joint comprising:

a pair of elongate fabrications of steel one for each side of the joint, the pair of elongate fabrications each having:

a top and a bottom edge separated by the top-to-bottom depth; and means for frangibly fastening the pair of elongate fabrications together, in metal-to-metal contact prior to and during pouring of the slabs; and the pair of elongate fabrications including:

means for anchoring the pair of elongate fabrications in the slabs on opposite sides of the joint;

two arris protection members, one in each elongate fabrication of the pair of elongate fabrications for protecting an arris of one of the slabs at one of the opposite sides of the joint;

the two arris protection members:

being complementarily formed along a length of the joint with a regular wave shape, with each arris protection member extending with a regular wave shape across a mid-plane of the joint from one side to the other side and back again at successive positions along the joint at least whilst the pair of elongate fabrications remain frangibly connected;

having a width transverse the length of the joint giving the joint the top-to-bottom depth, the width being suitable for the depth of load bearing slabs;

being single pieces configured to act together as a divider for dividing the slabs with the top edges flush with each other and with the bottom edges flush with each other; and the regular wave shape extending throughout the depth of the arris protection members, including each arris protection member, whereby on pouring, the slabs are formed with interdigitated concrete fingers edged at the slabs' arrises by the arris protection members and extending through the entire depth of the slabs; and dowels, which are welded-in-place extending outwards of the mid-plane of the joint on one side of the joint and having sleeves extending on the dowels on the other side of the joint for transferring a vertical load between the slabs on opposite sides of the joint, wherein:

the means for anchoring comprises continuous welded-on members, the welding being at the furthest extent of the arris-protection members from the mid-plane of the joint, that is at lateral wave peaks;

the dowels being welded to the arris-protection member on the one side of the joint and to the continuous welded-on anchor members at this one side of the joint;

whereby after casting and shrinkage of the slabs, the free movement, arris protection, construction joint has:

each of the arris protection members abutting one of the slabs, with a pair of arris protection members being separated by shrinkage of the slabs, with the frangible fastening together of the arris protection members being broken; and each dowel remaining within a respective one of the sleeves on the other side of the joint.

2. A free movement, arris protection, construction joint according to claim 1, wherein the regular wave shape is selected from the group consisting of: curved, sinusoidal, angular, saw tooth, triangular, square and trapezoidal.

3. A free movement, arris protection, construction joint according to claim 1, wherein the continuous welded-on members are angle members with apertures punched for anchoring in the concrete.

4. A free movement, arris protection, construction joint according to claim 1, wherein the continuous welded-on members are lengths of reinforcing bar.

5. A free movement, arris protection, construction joint according to claim 1, wherein the means for anchoring are set down from flush top edges of the arris protection members.

6. A free movement, arris protection, construction joint according to claim 5, wherein the means for anchoring or part thereof is set down from the top of the joint by not more than one third the top-to-bottom depth of the slab.

7. A free movement, arris protection, construction joint according to claim 5, wherein the dowels are set down from the top of the joint by more than one third the top-to-bottom depth of the slab.

8. A free movement, arris protection, construction joint according to claim 5, wherein the dowels are a plate.

9. A free movement, arris protection, construction joint according to claim 5, wherein the dowels are a bar.

10. A free movement, arris protection, construction joint according to claim 5, wherein an end of the joint is complementarily formed for connection of another such joint to the end of the joint, the joint having:

a portion of one arris protection member extending beyond an other arris protection member at one end, a complementary portion of an other arris protection member extending beyond the one at an other end and means for frangibly fastening the portion and the complimentary portion together for fastening the joint to another such joint.

11. A free movement, arris protection, construction joint according to claim 10, wherein part of the means for anchoring at a side of the joint having one portion extends onto and is fixed onto the one portion and is fixed onto the means for anchoring of the joint short of the complementary portion of the other arris protection member.

12. A method of casting concrete slabs, comprising:

providing, on a sub-base, a free movement arris protection joint according to claim 1, along either side of which concrete slabs are to be cast;

casting a first slab against a first side of the joint; and casting a second slab against an other side of the joint, whereby the first and second slabs are cast with a horizontally castellated edge, the horizontally castellated edge of the first slab being interdigitated with the horizontally castellated edge of the second slab, each horizontally castellated edge being bound by an arris protection member and extending through a full depth of the slab to the sub-base.

* * * * *